United States Patent [19]

Janke et al.

[11] Patent Number: 4,920,758

[45] Date of Patent: May 1, 1990

[54] REFRIGERATOR TEMPERATURE RESPONSIVE AIR OUTLET BAFFLE

[75] Inventors: Donald E. Janke, Benton Township, Berrien County; Edwin H. Frohbieter, Lincoln Township, Berrien County, both of Mich.

[73] Assignee: Whirlpool Corporation, Benton Harbor, Mich.

[21] Appl. No.: 221,039

[22] Filed: Jul. 18, 1988

[51] Int. Cl.[5] ..... F25D 17/04

[52] U.S. Cl. ..... 62/187; 62/408

[58] Field of Search ..... 62/187, 186, 408; 98/34.6; 236/49 D; 165/16; 137/625.31

[56] References Cited

U.S. PATENT DOCUMENTS

| | | | |
|---|---|---|---|
| 290,805 | 12/1883 | Sexton | 62/421 |
| 2,012,527 | 8/1935 | Batchelder, Jr. | 236/49 B |
| 2,212,356 | 8/1940 | Shure | 98/34.6 X |
| 2,367,502 | 1/1945 | Hube | 236/49 B |
| 3,149,293 | 9/1964 | Farkas | 236/46 F |
| 4,282,720 | 8/1981 | Stottmann et al. | 236/49 X |
| 4,308,567 | 12/1981 | Mark | 361/187 |
| 4,409,639 | 10/1983 | Wesner | 361/167 |
| 4,450,897 | 5/1984 | Iijima et al. | 62/187 X |
| 4,662,186 | 5/1987 | Park | 62/408 X |
| 4,682,747 | 7/1987 | Janke | 62/187 |
| 4,688,393 | 8/1987 | Linstromberg et al. | 62/187 |
| 4,732,010 | 3/1988 | Linstromberg et al. | 62/187 |
| 4,735,057 | 4/1988 | Janke | 62/187 |

FOREIGN PATENT DOCUMENTS 1228139 10/1987 Canada .

*Primary Examiner*—William E. Wayner

*Attorney, Agent, or Firm*—Wood, Dalton, Phillips, Mason & Rowe

[57] ABSTRACT

An air circulation system for a refrigeration apparatus provides a controllable baffle for selectively opening or closing dual output ports. Particularly, the refrigeration apparatus includes an evaporator and an evaporator fan providing flow of refrigerated air. The fresh food compartment is to be cooled by the refrigerated air. First and second air inlet passages are provided in communication with the fan and upper and lower zones in the compartment for delivering refrigerated air in the compartment. First and second air outlet passages are provided in communication with the compartment and the fan for returning air from the compartment upper and lower zones to the fan. A baffle is mounted at the first and second air outlets and has independent open positions for each outlet allowing movement of air through its associated zone, and a closed position for each outlet preventing movement of air through such zone. A control is provided for selectively operating the baffle to assume any one of four positions for selectively opening or closing each port outlet according to the sensed temperature in the zone as compared to a desired temperature.

14 Claims, 2 Drawing Sheets

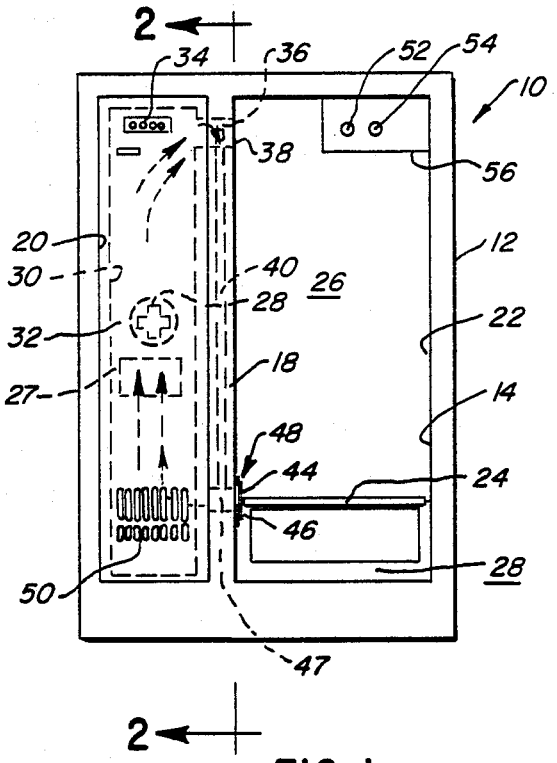
FIG. 1
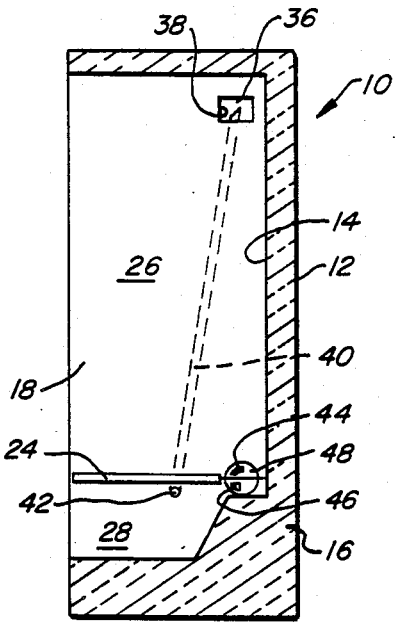
FIG. 2
FIG. 6
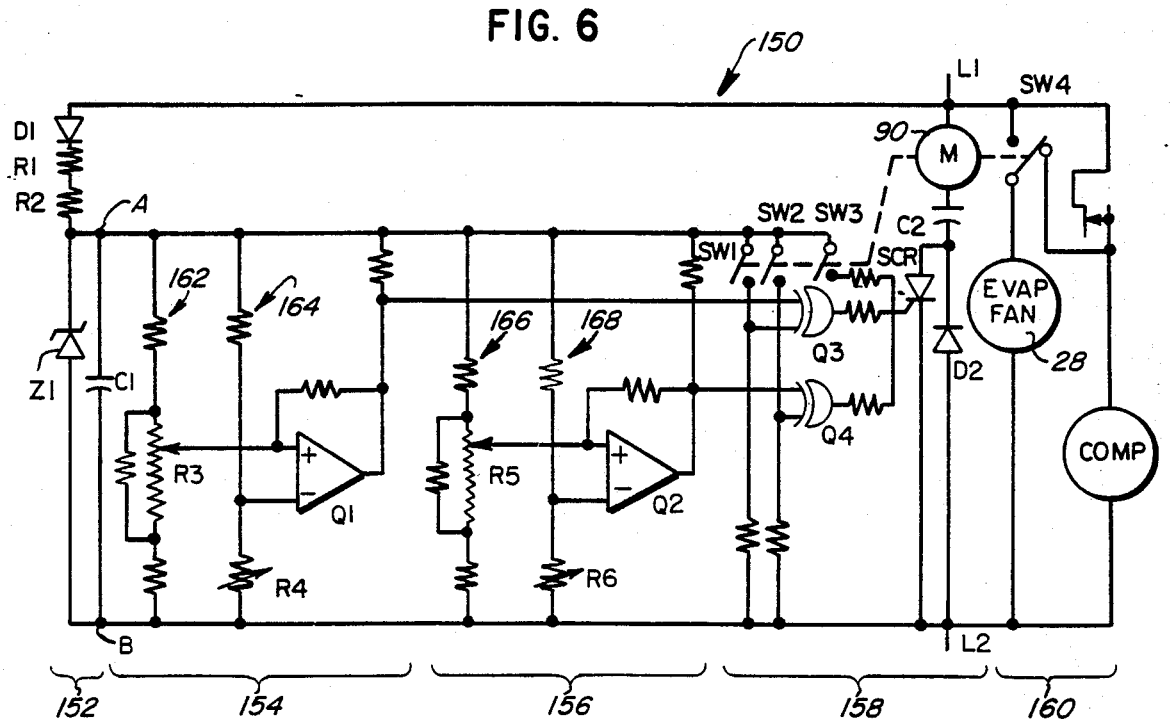

FIG. 4
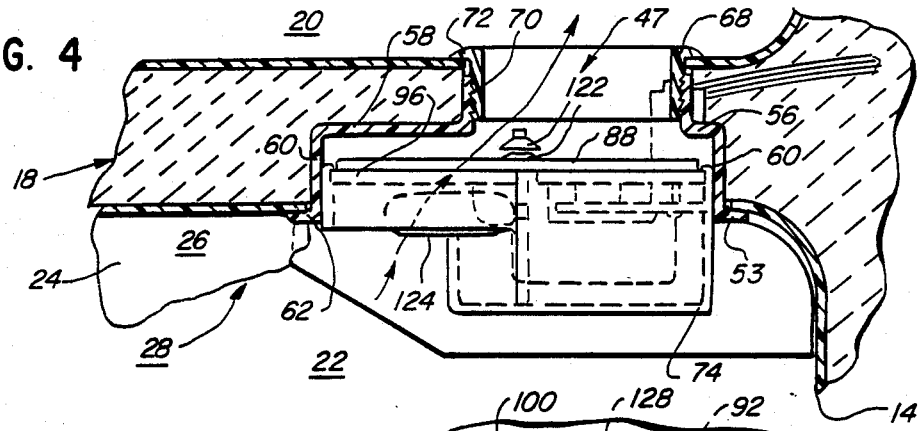
FIG. 3
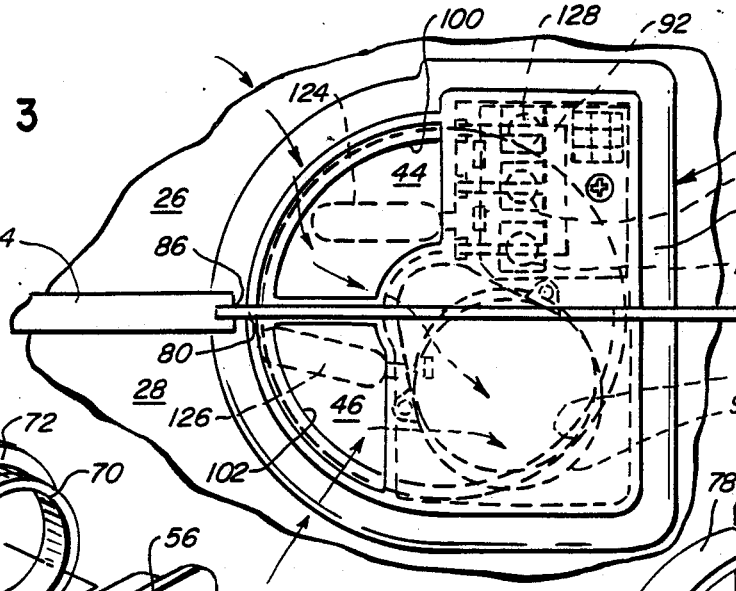
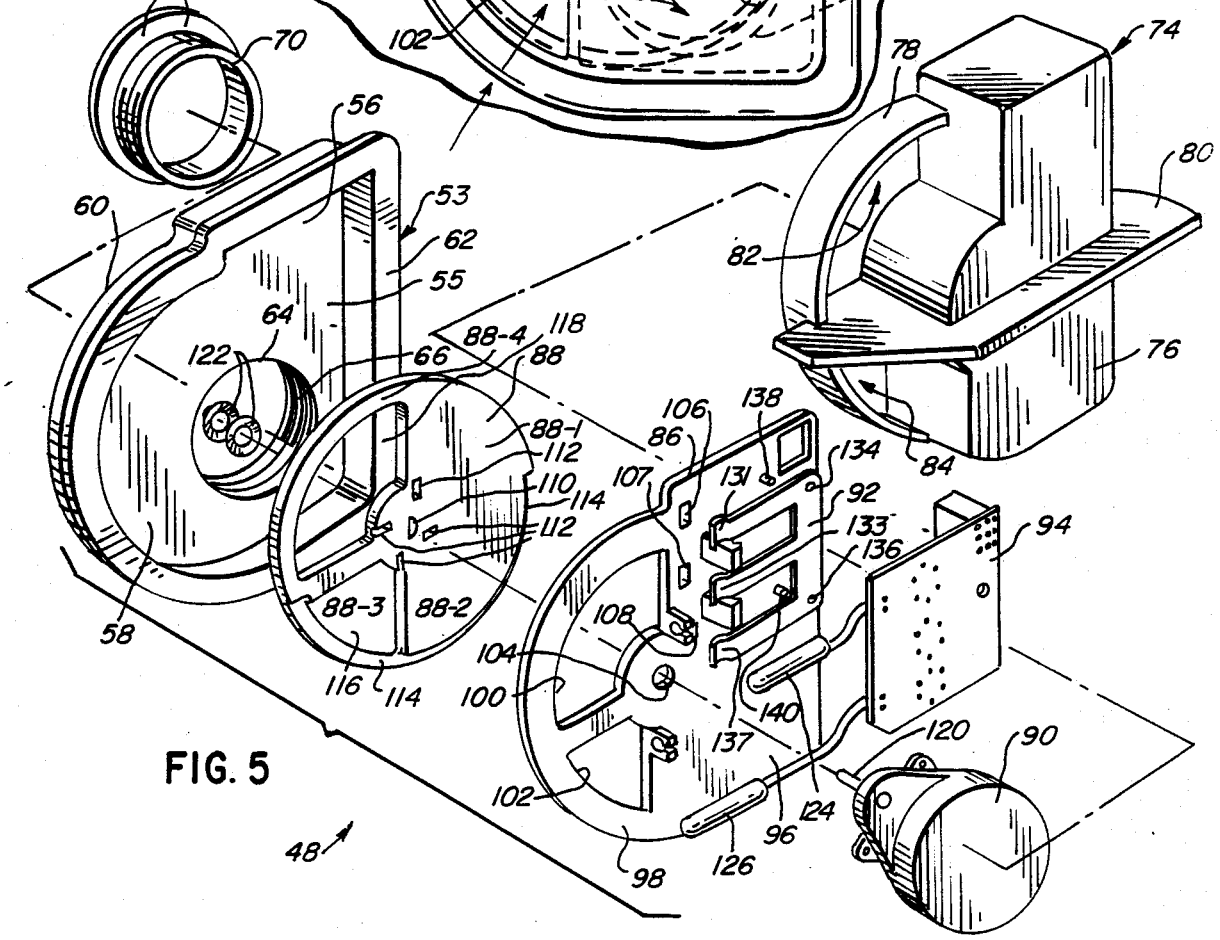
FIG. 5

REFRIGERATOR TEMPERATURE RESPONSIVE AIR OUTLET BAFFLE

BACKGROUND OF THE INVENTION

1. Field of the Invention

This invention relates generally to refrigerator air circulation systems and, more particularly, to an improved air circulation system for controlling the position of a baffle in a dual zone circulation system.

2. Description of Background Art

Conventional dual compartment refrigerators of the forced air circulation type utilize a single evaporator and an evaporator fan for cooling a freezer compartment thereof. The freezer compartment is coupled by a plurality of air passages through a divider wall to a fresh food compartment. An air baffle has been located within the fresh food compartment air inlet passage. The baffle is operable to control the passage of refrigerated air into the fresh food compartment. Such an arrangement is shown in Janke, U.S. Pat. No. 4,682,474, assigned to the assignee of the present invention.

With such a conventional refrigerator, if the refrigeration unit is operating, then the evaporator fan forces the air flow across the evaporator coils and out the top of the freezer into a scoop which directs air into the fresh food compartment, past the baffle. The fan flow overcomes natural conductive flow caused by air density differences. Resultantly, with the fan on, air enters at the top, circulating within the fresh food compartment, and returns out the bottom through an air outlet passage back to the freezer compartment.

During a conventional automatic defrost cycle, moisture can accumulate on the baffle. Once the defrost cycle is complete, the subsequent unit cycle time is of greater length since the cabinet must overcome heat produced by the defrost heater. The colder air from the evaporator coils can cause moisture on the baffle to freeze. The resulting ice prevents free movement of the baffle resulting in over-cooling of the fresh food compartment.

When the evaporator fan is off, air flow is controlled by a natural convection. The colder freezer air flows from the freezer bottom in a reverse direction through the compartment air outlet into the bottom of the fresh food compartment. With high ambient temperatures, where unit off time is short, such periods of uncontrolled back flow are short in duration so that performance is not hampered. However, with lower ambient temperatures, the unit off time tends to be greater in duration resulting in periods of uncontrolled back flow being longer. These long periods of back flow may result in the bottom portion of the fresh food compartment being overcooled causing freezing of articles therein.

Janke et al co-pending application, owned by the assignee of the present invention, describes a refrigeration apparatus which is provided with a controllable baffle at the fresh food compartment air outlet to minimize uncontrolled back flow. Also, a plurality of air inlets are included, including an air inlet located at the bottom section of the fresh food compartment, to provide for direct cooling at preselected zones of the refrigerator. Temperature control is provided by the position of the single air outlet baffle. Since a single outlet baffle is used, temperature is generally uniform throughout the fresh food compartment.

The present invention improves on the above refrigerator air circulation systems in a novel and simple manner.

SUMMARY OF THE INVENTION

In accordance with the present invention, a refrigeration apparatus is provided with a controllable baffle for selectively opening and closing first and second fresh food compartment air outlets to provide additional control of cooling in the fresh food compartment.

Broadly, there is disclosed herein a refrigeration apparatus including a compartment to be cooled by refrigerated air, inlet means for delivering the refrigerated air to the compartment, first and second outlet means for providing first and second air return passages, baffle means for selectively opening and closing the first and second air return passages, and control means operatively associated with the baffle means for controlling the baffle means to selectively open and close the first and second air return passages to control movement of air through the compartment.

The refrigeration apparatus according to the invention includes a freezer compartment and a fresh food compartment. The freezer compartment houses an evaporator fan which draws air across the evaporator to provide refrigerated air. A divider wall separates the freezer compartment from the fresh food compartment. A first passage is provided for delivering refrigerated air from the fan to the fresh food compartment at an inlet located at the top thereof. A second passage is provided for returning air from the fresh food compartment to the freezer and includes first and second air outlets located in first and second zones of the fresh food compartment. Associated with the air outlets is a baffle, the baffle having closed and open positions for each of the first and second air outlets. A control is operable to move the baffle to selectively open and close the first and second air outlets to control the movement of air through the fresh food compartment, particularly to provide dual zone cooling thereof.

In the preferred embodiment, the fresh food compartment includes a transverse shelf of generally solid construction mounted proximate a bottom portion of the fresh food compartment and defining upper and lower zones therein. The first and second air outlets are respectively located above and below the shelf. Resultantly, controlling the baffle to selectively open or close each of the air outlets permits air to flow in a more controlled manner through the upper and lower zones.

It is another feature of the present invention to provide a second air inlet associated with the first air passage located at the bottom section of the refrigeration apparatus, below the shelf, to provide for more direct cooling to the lower zone. Improved dual zone cooling is provided resulting from an air inlet being associated with each of the air outlets Still another feature of the present invention is to provide first and second air outlets being located approximate one another and the baffle comprising a four position baffle operable to independently and selectively open or close each of the first and second air outlets.

Particularly, the baffle includes a rotary plate having dual apertures therethrough, with the dual apertures being selectively aligned or disaligned with either or both of the first and second air outlets to control movement of air through the respective upper and lower zones.

A control circuit is provided including temperature sensing means associated with each of the upper zone and lower zone, to particularly control temperature independently in each zone.

Further features and advantages of the invention will readily be apparent from the specification and the drawings.

BRIEF DESCRIPTION OF THE DRAWINGS

FIG. 1 is a front elevational view of a refrigerator having an air circulation system embodying the invention, the compartment doors being omitted to facilitate illustration of the components therein;

FIG. 2 is a sectional view taken along the lines 2—2 of FIG. 1 with the storage pan removed;

FIG. 3 is a partially cut away elevational view which illustrates the four position air outlet baffle of FIGS. 1 and 2;

FIG. 4 is a partially cut away plan view of the baffle of FIG. 3;

FIG. 5 is an exploded view of the baffle of FIG. 3; and

FIG. 6 is an electrical schematic of a control circuit for the baffle of FIG. 3.

DETAILED DESCRIPTION OF THE PREFERRED EMBODIMENT

Referring to FIGS. 1 and 2, a refrigeration apparatus, such as a refrigerator/freezer 10, includes an air circulation system according to the present invention. The invention is shown utilized with a side-by-side refrigerator/freezer 10. However, other types of refrigeration apparatus may be used in conjunction with the present invention, as will be obvious to those skilled in the art.

The refrigerator/freezer 10 includes a cabinet 12 housing a conventional liner 14 therein with suitable insulation 16 provided between the liner 14 and the cabinet 12. The liner 14 includes a plurality of wall portions, as is well known, and may be of one piece construction or of multiple piece construction, as necessary, or desired. The refrigerator/freezer 10 includes an insulating separator or divider wall 18 which may utilize the liner wall portions. The cabinet 12, the liner 14 and divider wall 18 define a below-freezing, or freezer, compartment 20 and a fresh food, or above-freezing, compartment 22. Suitable doors (not shown) are provided for selective access to the freezer and fresh food compartments 20 and 22.

Provided in the fresh food compartment 22 is a lower transverse shelf 24. The shelf 24 is of generally solid construction, such as of glass or plastic, and is fastened to the various wall portions, as is well known. The shelf 24 and liner wall portions collectively define a fresh food compartment upper zone 26 and a fresh food compartment lower zone 28, respectively located above and below the shelf 24.

The freezer and fresh food compartments 20 and 22 are cooled by circulating refrigerated air therethrough which has been refrigerated as a result of being passed in heat exchange relation with a conventional evaporator 26. An evaporator fan 28 draws air across the evaporator 27, with the cooled air passing through a duct 30 behind a rear wall 32 of the freezer compartment 20 and further through, a freezer compartment air inlet 34. The duct 30 is also in communication with a scoop, or passage, 36 in the separator 18 to a fresh food compartment upper air inlet 38. Specifically, the upper air inlet 38 comprises an opening through the divider 18 which is in communication with the freezer compartment duct 30. The inlet 36, such as a conventional vent, includes suitable openings for enabling refrigerated air to be delivered to the fresh food compartment upper zone 26. An elongated tube 40 extends diagonally from within the passage 36, downwardly and forwardly through the separator wall 18. The tube 40 terminates in a fresh food compartment lower air inlet 42, located below the lower shelf 24, to deliver refrigerated air to the fresh food compartment lower zone 28.

Refrigerated air that passes through the passage 36 is discharged through the air inlets 38 and 42 to circulate within the fresh food compartment 22 and subsequently return to the evaporator duct 30 through respective first and second air outlets, 44 and 46 that are in communication with a return passage 47 located in the separator 18 at the rear of the fresh food compartment 22. The air outlets 44 and 46 are positioned above and below the lower shelf 24. A selectively positionable baffle 48 overlays the outlets 44 and 46 and is operated by a control circuit, discussed in greater detail below, to control the passage of return air from the fresh food compartment 22 to the evaporator duct 30, to thus control the circulation of air in the fresh food compartment 22.

The refrigerated air in the freezer compartment 20 returns to the duct 30 through a freezer compartment air outlet 50 and mixes with the air returned from the fresh food compartment 22. The mixed air is drawn by the evaporator fan 28 across the evaporator 27 during a cooling unit on cycle to remove heat therefrom and recirculate the air in the compartments 20 and 22.

In addition to the evaporator 27 and the evaporator fan 28, the refrigeration apparatus 10 includes connected components such as a compressor, a condenser, a condenser fan and a defrost heater, not shown, as is well known.

The desired temperature for the fresh food compartment 22 is user selectable to independently controlling temperature in the upper zone 26 and the lower zone 28. A fresh food upper zone temperature set point control knob 52 and a fresh food lower zone temperature set point control knob 54 are mounted to a control panel 56 at the top of the fresh food compartment 22. The cooling of the upper and lower zones 26 and 28, respectively, is controlled in accordance with the actual temperature in each zone as determined by temperature sensors discussed in greater detail below.

Referring to FIGS. 3 and 4, the baffle 48 is illustrated in greater detail. Also referring to FIG. 5, which is provided for ease of explanation, an exploded view of the baffle 48 is provided.

The baffle 48 includes a cabinet sleeve 53 for mounting to the separator 18. The sleeve 53 comprises a generally planar wall 55 which includes a rectangular shaped section 56 joining a semicircular shaped section 58. The outer edges of the wall 55 extend to a turned peripheral wall 60 which has an outwardly extending flange 62 thereon. A circular aperture 64 is provided through the wall 55 and includes a cylindrical wall 66 extending therefrom in a direction opposite that of a peripheral wall 60. The inner surface of the cylindrical wall 66 is threaded. The sleeve 53 is preferably of one piece plastic construction.

A coupling member 68 includes a cylindrical wall 70 having an outer turned flange 72. The cylindrical wall 70 includes an outer diameter less than the inner diameter of the cabinet sleeve cylindrical wall 66. The outer surface of the cylindrical wall 70 is threaded so that the coupling member 68 is matable with the cabinet sleeve cylindrical wall 66.

A suitable opening is provided in the divider wall 18 for mounting the baffle 48. Particularly, a circular opening is provided in the divider wall 18 on the freezer side 20 which opening is larger than the outer diameter of the coupling member cylindrical wall 70, but less than the diameter of the flange 72. Similarly, an opening is provided through the fresh food compartment side of the divider wall 18, which opening is shaped similar to that the cabinet sleeve peripheral wall 60. Thus, the cabinet sleeve 53 is inserted in the divider wall on the fresh food compartment side, and is mated with the coupling member 68 which is inserted from the freezer side. Specifically, the two are threadably coupled, as is particularly illustrated in FIG. 4. The opening through the coupling member 76 defines the return passage 47, See FIG. 1. Additionally, although not shown, a suitable adhesive is provided for securing the cabinet sleeve flange 62 and the coupling member flange 72 to the divider wall 18 to provide an adequate seal therebetween.

A baffle cover 74 includes a substantially rectangular shaped enclosure 76, coupled an arcuate wall 78. A planar shelf 80 extends outwardly from the enclosure 76 and is joined to the arcuate wall 78. The cover 74 thereby defines an upper opening 82 between the arcuate wall 78, the enclosure 76 and the upper side of shelf 80 and a lower opening 84 between the arcuate wall 78, the enclosure 76 and the lower side of the shelf 80. The housing 74 is sized to fit within the cabinet sleeves peripheral wall 60 and to be held therein in a conventional snap fit manner. When so mounted, the shelf section 80 is received within a suitable groove 86 provided in the fresh food compartment shelf 24. This results in the shelf portion 80 effectively acting as part of the lower shelf 24.

With the cover 74 mounted to the sleeve 53, the first and second cover openings 82 and 84, respectively, are in communication with the passage 47 from the fresh food compartment upper zone 26 and lower zone 28 to the freezer compartment 20, as illustrated by the arrows in FIGS. 3 and 4 showing the air flow path. Therefore, the openings 82 and 84 comprise the respective air outlets 44 and 46.

In order to controllably, independently, and selectively open and close the upper and lower air outlets 44 and 46, respectively, the baffle 48 includes a base member 86, a baffle disk 88, a motor 90, a switch cam follower 92 and a control circuit board 94.

The base 86 is of generally planar construction and includes a rectangular section 96 joined to a circular section 98. The overall shape is similar to that of the cabinet sleeve planar wall 55, although slightly smaller in size. First and second arc shaped openings 100 and 102 are provided in the circular section 98, along with a circular opening 104 at the radial center thereof. The upper opening 100 extends approximately 90 degrees relative to an axis of the central opening 104. The lower opening 102 is of smaller size. The base rectangular section 96 includes three relatively small longitudinally spaced rectangular shaped openings 106, 107 and 108. These openings 106–108 are positioned adjacent the upper opening 100.

The baffle disk 88 is of circular shape and may be thought of as being divided into four quadrants, namely 88-1, 88-2, 88-3 and 88-4. Each of these quadrants surrounds a central axis which includes a semicircular opening 110 therethrough. A notch 112 is provided in each quadrant radially spaced from the opening 110 and positioned circumferentially at the beginning of each quadrant. For example, the notch 112 in the first quadrant 88-1 is positioned near the fourth quadrant 88-4. Otherwise, the first quadrant 88-1 is generally planar. The second quadrant, 88-2 is also generally planar, except that a circumferential groove 114 is provided at the outer peripheral edge thereof. The third quadrant 88-3 also includes the circumferential groove 114 continuing from that in the second quadrant 88-2. An opening 116 is provided through the third quadrant 88-3 and is generally in the shape of a quarter circle. The fourth quadrant 88-4 includes a similar quarter circle shaped opening 118 and is otherwise generally planar.

The motor 90 comprises a timer motor and includes an axial shaft 120 extending therefrom. The motor 90 is fastened to the base 86 in any known manner such that the motor shaft 120 extends through the central opening 104 thereof. The baffle disk 88 is mounted to the motor shaft 120 as by passing the motor shaft 120 through the baffle disk central opening 110 and securing it thereto using suitable fastening elements 122.

Operation of the motor 90 causes the baffle disk 88 to rotate in a counterclockwise direction relative to the base 86. Particularly, the baffle disk 88 is rotated so that its respective openings 116 and 118 are in selective alignment or disalignment with the openings 102 and 100 of the base 86. As is apparent, if one of the disk openings 116 or 118 is in alignment with the base upper opening 100, then the upper outlet 44 of the fresh food compartment 22 is in the open position permitting refrigerated air to flow through the upper zone 26 and be returned through the outlet 44 and the passage 47 returning to the freezer compartment 20. Similarly, if either disk opening 116 or 118 is in alignment with the base lower opening 102, then refrigerated air flows through the lower zone 28 and is returned through the air outlet 46 through the passage 47 to the freezer compartment 20. If neither disk opening 116 or 118 is aligned with either of the plate openings 100 or 102, then its associated outlet 44 or 46 is closed preventing air flow through the associated zone 26 or 28, respectively.

The use of such a baffle disk 88 results in the ability to selectively and independently open or close the upper zone and lower zone air outlets 44 and 46, respectively. Thus, the baffle 48 comprises a dual zone four position baffle.

In order to control baffle positioning, a suitable circuit is provided on the circuit board 94 for sensing operating conditions. Particularly, electrically connected to the circuit board 94 are upper zone and lower zone temperature sensors 124 and 126, respectively. The circuit board 94 is mounted to the base 86 in a conventional manner The sensors 124 and 126 are positioned within the air outlets 44 and 46, respectively, as illustrated particularly in FIG. 3. Accordingly, the sensors are operable to sense temperature of air passing through the outlets 44 and 46, respectively representing air temperature in the upper zone 26 and lower zone 28.

Also included on the circuit board 94 are first, second and third baffle position switches 128–130, respectively, see FIG. 3. The switches 128–130 are conventional switches which include movable actuators for moving a normally open contact therein between an open and a closed position as is well known. The switches 128–130 are operated by the switch cam follower 92. The switch cam follower is of E-shaped construction and is formed of a flexible metal. The end portions of the three legs 131—133 of the cam follower 92 are turned in an arcuate shape. The cam follower 92 includes first and second openings 134 to 136 for mounting the cam follower 92 to respective tabs 138 and 140 on the base 86. Once mounted, the respective ends of legs 131—133 are disposed within and extend through the rectangular openings 106–108 of the base plate 86. Specifically, the leg ends 131–133 extend through the openings 106–108 a sufficient amount so that if a portion of the baffle disk 88 is disposed in circumferential alignment with one of the legs 131–133, the particular leg is flexed upwardly so that its associated respective switch 128–130 is in an actuated position. In the actuated position, the switch contact closes. The openings 106–108 are positioned so that the ends of the cam follower legs 131–133 sense the surface of the baffle disk 88 for whichever quadrant of the disk 88 is positioned in the upper right hand area, as is illustrated in FIG. 3. Illustratively, if the disk fourth quadrant 88-1 is across from the base upper opening 100, as shown in FIG. 3, the cam follower legs 131–133 sense the surface of the first quadrant 88-1.

The first switch 128 and the associated cam follower first leg 131 are used to sense the position of the baffle disk relative to the upper zone air outlet 44. The first leg 131 is radially positioned to sense the peripheral edge of the baffle disk 88. If the peripheral groove 114 is adjacent the first leg 131, then the first switch 28 is not actuated and its contact is in the normally open position. This occurs if either the first or second quadrant 88-1 or 88-2 is positioned across from the base upper opening 100. Conversely, if either the third or fourth quadrant 88-3 or 88-4 is positioned across from the base plate upper opening 100, then the first leg 131 is biased to actuate the first switch 128, thus closing its contact.

The second switch 129 and its associated cam follower second leg 132 are used to sense the position of the baffle disk 88 relative to the lower zone air outlet 46. Particularly, if the disk plate first or second quadrant 88-1 or 88-2 is across from the base plate lower opening 102, indicating that the lower zone air outlet 46 is in the closed position, then the second cam follower leg 132 extends through one of the openings 116 or 118 of the baffle disk 88. This results in the second switch 129 not being actuated, and the contact is in its normally open position. Conversely, if either the third or fourth quadrant 88-3 or 88-4 is across from the lower opening 102, indicating that the lower air outlet 46 is in the open position, then the second leg is biased upwardly since it abuts against the surface of either the first or second quadrant 88-1 or 88-2. This results in the second switch 129 being actuated such that its contact is closed.

For example, if the first quadrant 88-1 is across from the upper opening 100, and the fourth quadrant 88-4 is across from the lower opening 102, indicating that the upper air outlet 44 is closed and the lower air outlet 46 is open, then the position of the switches 128-130 is determined by the second quadrant 88-2. Specifically, the first switch 128 is unactuated owing to the end of the cam follower first leg 131 being disposed within the peripheral groove 114. The end of the cam follower second leg 132 abuts the surface of the second quadrant 88-2 so that the second contact 129 is in the actuated, or closed position.

As is evident from the above, the electrical contacts of the first and second switches 128 and 128 are open when its associated respective air outlet 44 and 46 is closed, while the contacts are closed if the associated outlet is open.

The third switch 130 and the associated cam follower third leg 133 are provided for sensing if the baffle disk 88 is in an intermediate position, i.e., in the process of moving between one of the four desired positions. Particularly, the baffle disk notches 112 are provided so that when the baffle disk is in one of the four desired positions, then the end of the third leg 133 extends into one of the baffle disk notch portions 112 resulting in the third switch 130 being in the unactuated position. Conversely, if the baffle disk is an intermediate position, then the baffle disk surface biases the cam follower third leg 133, since it does not extend in one of the notch portions 112, resulting in the third switch 130 being actuated so that its contact is closed.

An electrical schematic of a control circuit 150 for operating the motor 90 is illustrated in FIG. 6. The control circuit 150 includes a power supply circuit 152, an upper zone temperature control circuit 154, a lower zone temperature control circuit 156, a motor control circuit 158 and a refrigeration unit cycle control circuit 160.

The power supply circuit 152 includes a diode D1, resistors R1 and R2 and a capacitor C1 serially coupled between the terminals L1 and L2 of a power source. A zener diode Z1 is connected in parallel with the capacitor C1. The power supply circuit 152 is operable to convert 120v AC supply connected across terminals L1 and L2 to a DC voltage present between terminals A and B.

The upper zone temperature control circuit 154 includes first and second voltage divider circuits 162 and 164. The first voltage divider circuit 162 includes a variable resistor R3 connected to the non-inverting input of a first comparator Q1. The second voltage divider circuit 164 includes a variable resistor R4 connected to the inverting input of the first comparator Q1. The variable resistor R3 is a user-adjustable potentiometer which is mechanically linked to the upper zone set point control knob 52. The resistance value across the resistor R3 is directly proportional to the desired temperature value selected by the user. The variable resistor R4 represents the variable resistance output of the temperature sensor 124 previously described with reference to FIGS. 3–5. In the preferred embodiment, the temperature sensor 124 is a negative temperature coefficient (NTC) sensing thermistor which provides a resistance inversely proportional to the sensed temperature.

The first comparator Q1 compares the actual temperature as determined by the variable resistor R4 with the desired temperature as determined by the variable resistor R3. If the actual temperature in the upper zone is greater than the desired temperature, resulting in the voltage across the variable resistor R4 being less than that across the variable resistor R3 owing to the inverse current relationship provided by the NTC, then the output of the comparator Q1 is high. Conversely, if the actual temperature is below the desired temperature, then the voltage at the inverting input is higher than at the noninverting input, so that the output of the first comparator Q1 is low. If the output of the first comparator Q1 is high, then the upper zone air outlet 44 should be open to provide refrigerated air flow; while if the output of the first comparator Q1 is low, then the upper zone air outlet 44 should be closed to restrict air flow.

The lower zone temperature control circuit 156 includes voltage divider circuits 166 and 168 similar to the respective voltage divider circuits 162 and 164 of the upper zone circuit 154. A variable resistor R5, corresponding to the variable resistor R3, is a user-adjustable potentiometer which is mechanically linked to the lower zone set point control knob 54. A variable resistor R6 of the second voltage divider circuit 168, corresponding to the variable resistor R4, presents a variable resistor output of the temperature sensor 126 previously described with reference to FIGS. 3–5. The variable resistor R6 is also preferably an NTC sensing thermistor.

The lower zone temperature control circuit 156 operates similar to the upper zone circuit 154 resulting in the second comparator Q2 having a high output if it is desired that the lower zone air outlet 4S6 be in the open position, and a low output if it is desired that the lower zone air outlet 46 be in a closed position.

The motor control circuit 158 includes first and second exclusive OR, or XOR, gates, Q3 and Q4 respectively. The first XOR gate Q3 includes a first input connected to the comparator Q1 and a second input connected to an electrical switch SW1. The electrical switch SW1 comprises the electrical contact associated with the first position switch 128. The second XOR gate Q4 includes a first input connected to the output of the second comparator Q2 and a second input connected to a second switch SW2. The second switch SW2 is the electrical contact associated with the second switch 129. A third electrical switch SW3 comprises the contact associated with the third switch 130, and is coupled in parallel with the XOR gates Q3 and Q4 to the gate of a silicon controlled rectifier SCR. The SCR is connected in series with a capacitor C2 and the motor 90 between the power terminals L1 and L2. A diode D2 is reverse bias connected across the SCR. Resultantly, the SCR is gated if either Q3 or Q4 is high, or the third switch SW3 is closed. If the SCR is gated, then the motor 90 is energized to rotate the baffle disk 88 in the counterclockwise direction. The capacitor C2, the diode D2, the SCR and the motor 90 are arranged to minimize current draw.

In operation, the motor should be energized if it is necessary to change the baffle position. As discussed above, the switches SW1 and SW2 indicate the baffle's actual position. If the baffle outlet for the upper or lower zone is open, then its associated respective contact SW1 or SW2 is closed, indicating a high state. If the outlet baffle position is closed, then the associated contact SW1 or SW2 is open, indicating a low state. The comparators Q1 and Q2 are high if it is desired that its associated outlet baffle position be open, while the outputs are low if it is desired that the outlet baffle position be closed. Therefore, the XOR gates Q3 and Q4 compare the desired baffle position, determined by the respective associated comparators Q1 and Q2, with the actual baffle position, determined by their associated respective contacts SW1 and SW2. If there is a mismatch, then the appropriate gate Q3 or Q4 goes high, thus energizing the motor 90 via the SCR. Once the motor begins to operate, the third contact SW3 is closed while the baffle is in an intermediate position preventing stoppage at a half open or half closed position. The motor 90 continues to turn the baffle disk 88 until both baffle outlets 44 and 46 are in the desired open or closed position.

Conventional refrigerator circuits wire the evaporator fan in parallel with the compressor. Accordingly, the evaporator fan is on only when the compressor is on, or when the freezer needs cooling. However, it is desirable that if either air outlet 44 or 46 is open, then the evaporator fan 28 be energized. Accordingly, a two positioned switch SW4 is provided which connects the evaporator fan 28 either in parallel with the compressor or directly between the power terminals L1 and L2. Specifically, whenever any air outlet is open, the switch SW4 maintains the evaporator fan 28 energized to maintain proper air flow and to avoid back flow cooling.

Although the circulation system described herein includes dual air inlets, and dual temperature sensors, one for each zone, a circulation system according to the invention could be provided with only a single air inlet, as is obvious to those skilled in the art.

Thus, the invention broadly comprehends an air circulation system for providing direct cooling to dual zones in a fresh food compartment.

The foregoing disclosure of the preferred embodiment is illustrative of the broad inventive concepts by the invention.

I claim:

1. A refrigeration apparatus comprising:

a compartment to be cooled by refrigerated air;

refrigerated air providing means for circulating refrigerated air;

air inlet means for providing an air inlet passage, through which air flows from the refrigerated air providing means to said compartment;

first air outlet means for providing a first air return passage, through which air flows from said compartment to said refrigerated air providing means;

second air outlet means for providing a second air return passage, through which air flows from said compartment to said refrigerated air providing means;

baffle means for selectively and independently opening and closing said first and second air return passages, said baffle means comprising a unitary baffle positioned at both said first and said second air outlet means; and temperature control means operatively associated with said baffle means for controlling said baffle means to selectively open and close said first and second air return passages to control the movement of air through said compartment to maintain said compartment at a desired temperature.

2. A refrigeration apparatus comprising:

a compartment to be cooled by refrigerated air;

refrigerated air providing means for circulating refrigerated air;

air inlet means for providing an air inlet passage, through which air flows from the refrigerated air providing means to said compartment;

first air outlet means for providing a first air return passage, through which air flows from said compartment to said refrigerated air providing means;

second air outlet means for providing a second air return passage, through which air flows from said compartment to said refrigerated air providing means;

baffle means for selectively opening and closing said first and second air return passages, said baffle means comprising a unitary baffle positioned at both said first and said second air outlet means, and further comprising a movable baffle mounted at said compartment first and second air outlet means, said baffle defining a first open position allowing movement of air through both said first and second air return passages, a second open position allowing movement of air through said first air return passage but not said second air return passage, a third open position allowing movement of air through said second air return passage but not said first air return passage, and a closed position preventing movement of air through both said first and second air return passages; and control means operatively associated with said baffle means for controlling said baffle means to selectively open and close said first and second air return passages to control the movement of air through said compartment.

3. A refrigeration apparatus comprising:

a compartment to be cooled by refrigerated air, said compartment including opposite upper and lower sections;

refrigerated air providing means for circulating refrigerated air;

air inlet means for providing an air inlet passage, through which air flows from the refrigerated air providing means to said compartment;

first air outlet means for providing a first air return passage, through which air flows from said compartment to said refrigerated air providing means, said first air outlet means being located at said upper section;

second air outlet means for providing a second air return passage, through which air flows from said compartment to said refrigerated air providing means, said second air outlet means being located at said lower section;

baffle means for selectively and independently opening and closing said first and second air return passages; and temperature control means operatively associated with said baffle means for controlling said baffle means to selectively open and close said first and second air return passages to control the movement of air through said compartment to maintain said compartment at a desired temperature.

4. In a refrigeration apparatus having means providing refrigerated air and a compartment to be cooled from air delivered thereto from the air providing means, said compartment having opposite top and bottom portions, an air circulation system comprising:

air flow means for causing flow of said refrigerated air;

first passage means in communication with said air flow means and said compartment and defining first and second compartment air inlets, one of said inlets being located at the top portion of said compartment, and the other of said inlets being at the bottom portion of said compartment, for delivering refrigerated air from said air providing means to said compartment;

second passage means in communication with said air flow means and said compartment and defining first and second compartment air outlets, one of said outlets being located at the top portion of said compartment, and the other said outlets being at the bottom portion of said compartment, for returning air from said compartment to said air providing means;

baffle means for selectively opening or closing each of said outlets of said second passage means, said baffle means comprising a unitary baffle positioned at both said first and said second air outlets; and temperature control means operatively associated with said baffle means for operating said baffle means to selectively open or close the air outlets to control movement of air through said compartment to maintain said compartment at a desired temperature.

5. In a refrigeration apparatus having means providing refrigerated air and a compartment to be cooled from air delivered thereto from the air providing means, said compartment having opposite top and bottom portions, an air circulation system comprising:

air flow means for causing flow of said refrigerated air;

first passage means in communication with said air flow means and said compartment and defining first and second compartment air inlets, one of said inlets being located at the top portion of said compartment, and the other of said inlets being at the bottom portion of said compartment, for delivering refrigerated air from said air providing means to said compartment;

second passage means in communication with said air flow means and said compartment and defining first and second compartment air outlets, one of said outlets being located at the top portion of said compartment, and the other said outlets being at the bottom portion of said compartment, for returning air from said compartment to said air providing means;

baffle means for selectively opening or closing each of said outlets of said second passage means, said baffle means comprising a movable baffle mounted at said compartment first and second air outlets, said baffle defining a first open position allowing movement of air through both said first and second air outlets, a second open position allowing movement of air through said first air outlet but not said second air outlet, a third open position allowing movement of air through said second air outlet but not said first air outlet, and a closed position preventing movement of air through both said first and second air outlets; and control means operatively associated with said baffle means for operating said baffle means to selectively open or close the air outlets to control movement of air through said compartment.

6. The air circulation system of claim 5 wherein said baffle means includes a fixed plate having a first aperture in communication with said first air outlet and a second aperture in communication with said second air outlet, and a movable plate movably mounted to said fixed plate, and said temperature control means includes means for moving said movable plate to selectively and independently cover or uncover said first and second apertures.

7. The air circulation system of claim 6 wherein said moving means comprises an electric motor, and said temperature control means further comprises:

set point means for preselecting a desired temperature;

means for sensing the temperature in the top portion of said compartment, and circuit means coupled to said set point means, said first and second sensing means and said motor for selectively operating said motor to move said movable plate responsive to said sensed temperature and said desired temperature.

8. The air circulation system of claim 7 wherein said set point means is operable to preselect a desired temperature for said compartment top portion, and further comprising second set point means for preselecting a desired temperature for the bottom portion of said compartment, and wherein said second set point means is coupled to said circuit means to operate said motor.

9. The air circulation system of claim 8 further comprising means coupled to said circuit means for sensing the position of said movable baffle, and wherein said circuit means is operable to energize said motor to open said first aperture only when the sensed temperature of the top portion of the compartment is greater than the top portion desired temperature, and to open said second aperture only when said compartment bottom portion temperature is greater than the desired compartment bottom portion temperature.

10. In a refrigeration apparatus having wall sections defining a compartment to be cooled by refrigerated air, means for providing refrigerated air, and a shelf mounted to said wall sections and defining an upper refrigeration zone thereabove and a lower refrigeration zone therebelow, an air circulation system comprising:

air flow means for causing flow of said refrigerated air;

air inlet means for providing an air flow passage through which air flows from said air flow means to said compartment;

first air outlet means for providing a first air flow return passage through which air flows from said compartment upper refrigeration zone to said air flow means;

second air outlet means for providing a second air flow return passage through which air flows from said compartment lower refrigeration zone to said air flow means;

a unitary baffle means positioned at said first and second air outlet means for individually, selectively opening or closing said first and second air flow outlet passages;

control means operatively associated with said baffle means for controlling said baffle means to selectively open or close said first air flow outlet passage to affect movement of air through said upper refrigeration zone and also to selectively open or close said second air flow outlet passage to affect movement of air through said lower refrigeration zone.

11. The air circulation system of claim 10 wherein said baffle means includes a fixed plate having a first aperture in communication with said first air outlet means and a second aperture in communication with said second air outlet means, and a movable plate movably mounted to said fixed plate, and said control means includes means for moving said movable plate to selectively and independently cover or uncover said first and second apertures.

12. In a refrigeration apparatus having wall sections defining a compartment to be cooled by refrigerated air, means for providing refrigerated air, and a shelf mounted to said wall sections and defining an upper refrigeration zone thereabove and a lower refrigeration zone therebelow, an air circulation system comprising:

air flow means for causing flow of said refrigerated air;

air inlet means for providing an air flow passage through which air flows from said air flow means to said compartment;

first air outlet means for providing a first air flow return passage through which air flows from said compartment upper refrigeration zone to said air flow means;

second air outlet means for providing a second air flow return passage through which air flows from said compartment lower refrigeration zone to said air flow means;

a baffle means positioned at said first and second air outlet means for individually, selectively opening or closing said first and second air flow outlet passages, said baffle means including a fixed plate having a first aperture in communication with said first air outlet means and a second aperture in communication with said second air outlet means, and a movable plate movably mounted to said fixed plate, and said control means includes means for moving said movable plate to selectively and independently cover or uncover said first and second apertures, said moving means comprising an electric motor;

control means operatively associated with said baffle means for controlling said baffle means to selectively open or close said first air flow outlet passage to affect movement of air through said upper refrigeration zone and also to selectively open or close said second air flow outlet passage to affect movement of air through said lower refrigeration zone, said control means further comprising set point means for preselecting a desired temperature, means for sensing the temperature in the upper zone of said compartment, and circuit means coupled to said set point means, said sensing means and said motor for selectively operating said motor to move said movable plate responsive to said sensed temperature and said desired temperature.

13. The air circulation system of claim 12 wherein said set point means is operable to preselect a desired temperature for said compartment upper zone, and further comprising second set point means for preselecting a desired temperature for the lower zone of said compartment, and wherein said second set point means is coupled to said circuit means to operate said motor.

14. The air circulation system of claim 12 further comprising means coupled to said circuit means for sensing the position of said movable plate, and wherein said circuit means is operable to energize said motor to open said first aperture only when the sensed temperature of the upper zone of the compartment is greater than the upper zone desired temperature, and to open said second aperture only when said compartment lower zone temperature is greater than the desired compartment lower zone temperature.

* * * * *